US006494243B1

(12) United States Patent
Switlik

(10) Patent No.: US 6,494,243 B1
(45) Date of Patent: Dec. 17, 2002

(54) APPARATUS FOR MAKING SELF-INFLATABLE APPARATUS

(75) Inventor: Stanley Switlik, 33 E. Welling Ave., Pennington, NJ (US) 08534

(73) Assignee: Stanley Switlik, Pennington, NJ (US)

( * ) Notice: Subject to any disclaimer, the term of this patent is extended or adjusted under 35 U.S.C. 154(b) by 57 days.

(21) Appl. No.: 09/708,169

(22) Filed: Nov. 8, 2000

Related U.S. Application Data

(62) Division of application No. 09/085,420, filed on May 27, 1998, now Pat. No. 6,190,486.

(60) Provisional application No. 60/064,483, filed on Nov. 6, 1997, and provisional application No. 60/078,145, filed on Mar. 16, 1998.

(51) Int. Cl.[7] ..... A47C 27/08; A47C 27/18

(52) U.S. Cl. ..... 156/468; 156/475; 156/477.1; 156/478; 156/479

(58) Field of Search ..... 156/468, 461, 156/475, 477.1, 478, 479

(56) References Cited

U.S. PATENT DOCUMENTS

| | | | | |
|---|---|---|---|---|
| 1,970,803 A | | 8/1934 | Johnson | |
| 3,650,872 A | * | 3/1972 | McKiernan | 156/216 |
| 3,675,377 A | | 7/1972 | Suter | |
| 3,872,525 A | * | 3/1975 | Lea et al. | 5/709 |
| 3,935,690 A | | 2/1976 | Lea et al. | |
| 4,025,974 A | * | 5/1977 | Lea et al. | 5/709 |
| 4,167,432 A | | 9/1979 | Mollura | |
| 4,339,487 A | * | 7/1982 | Mullet | 160/236 |
| 4,486,901 A | * | 12/1984 | Donzis | 2/465 |
| 4,908,895 A | | 3/1990 | Walker | |
| 4,991,244 A | | 2/1991 | Walker | |

* cited by examiner

*Primary Examiner*—Jeff H. Aftergut
(74) *Attorney, Agent, or Firm*—Richard C. Woodbridge, Esq; Stuart H. Nissim, Esq; Woodbridge & Associates, P.C.

(57) ABSTRACT

A self-inflatable mattress is formed from an open pore foam core and one or more layers of dual melt film. Initially, a layer of dual melt film is placed on top of the open pore foam block such that the side with the lower melting temperature contacts the foam core. A non-stick, heat transferable buffer layer is then placed on top of the film and heat and pressure are applied, preferably through a roller, causing the bottom surface of the film to stick to the top surface of the foam core. The edges of the top sheet are also adhesably attached to the sides of the core using a pair of heated side pressure rollers. Lastly, the cushion is inverted and a second, or bottom, sheet of dual melt film is placed on top of the foam core and attached to the bottom surface and sides in a similar manner. Finally, a valve, which may be either oral, or one way, is attached to the side of the mattress. The dual melt film adheres nicely to the sides of the mattress and to the other film to which it melts and bonds and to any indentations therein so that when it inflates it can assume a variety of compound shapes including convex, concave, or compound portions. Alternative embodiments of the invention permit the manufacturing of mattresses or cushions having a core including at least tow sections of foam having different densities or a king size mattress composed of two self-inflatable mattresses communicated together with a pair of valves. The cushions or mattresses formed according to the invention may be covered with a cloth or fabric cover for improved strength and durability.

6 Claims, 12 Drawing Sheets

APPARATUS FOR MAKING SELF-INFLATABLE APPARATUS

CROSS-REFERENCE TO RELATED APPLICATIONS

This application is a divisional of Ser. No. 09/085,420 filed on May 27, 1998, now U.S. Pat. No. 6,190,486 which claimed priority of my Provisional Patent Application Ser. No. 60/064,483 filed on Nov. 6, 1997 and entitled "ENTITLED FOAM TECHNOLOGY" and U.S. Provisional Patent Application Ser. No. 60/078,145 entitled "INFLATABLE EJECTION SEAT CUSHION" filed on Mar. 16, 1998, the entire contents of both of which are hereby incorporated by reference, in total, into this patent application.

BACKGROUND OF THE INVENTION

1. Field of the Invention

The invention relates to a method and apparatus for making a self-inflatable air mattress or cushion having an adjustable firmness characteristic and the product formed thereby.

2. Description of Related Art

The prior art literature describes several early efforts to make self-inflatable mattresses and the like. For example, U.S. Pat. No. 3,935,690 entitled "Method of Packaging and Unpackaging a Self-Inflating Air Mattress" describes a mattress which can be used for camping and which includes an open cell foam core covered with a air impervious material having a fabric exterior. Such mattresses are satisfactory for certain camping purposes but such mattresses tend to be thin and the edge of such mattresses tend not to be physically attached to the exterior covering material.

U.S. Pat. No. 3,675,377 describes another typical inflatable structure including a flexible foam core portion and a fabric covering.

The problem with structures such as described in U.S. Pat. Nos. 3,675,377 and 3,935,690 is that the exterior material is not bonded to the entire surface of the foam core but, rather, acts like a bag so that when the structure is inflated the sides or edges tend to round out. Accordingly, it is virtually impossible to form a self-inflatable mattress, using prior art techniques, which includes concavities or compound three-dimensional shapes.

FIG. 1A illustrates, in cross-sectional detail, a typical prior art self-inflatable mattress having a core and a covering. Because the coverings tend to be fabric, it is not possible to make a lap seam without losing air as shown in FIGS. 1B and 1C.

If the fabric illustrated in FIGS. 1B and 1C is sealed on only one side, then air tends to escape in the manner indicated. FIG. 1B illustrates a prior art "fin" seam and FIG. 1C illustrates a prior art "overlap" seam. It is also possible to make an overlap seam, such as illustrated in FIG. 1C, using fabric that is coated on both sides with a cement material between the two layers. Such prior art structures have several major disadvantages. First, and foremost, fabric covers, whether or not wholly or partially sealed on both sides, wrinkle when they turn corners and/or are compressed. Therefore, they cannot adequately conform to irregular shapes and tend to leak. Second, it is not possible to form a satisfactory thermoplastic welded seal between two overlapping layers of single sided coated cloth material, such as illustrated in FIG. 1C. Third, and last, the prior art techniques such as illustrated in FIGS. 1A–1C usually require adhesives or chemicals which are environmentally hazardous.

Other inflatable mattresses or structures are unknown in the prior art. See, for example, U.S. Pat. No. 1,970,803 which describes a method of making an inflatable rubber structure, such as a bed mattress. U.S. Pat. No. 4,991,224 describes an air mattress that includes a means for controlling the density and the relative firmness thereof depending upon the side of the mattress being occupied. Similarly, note U.S. Pat. No. 4,908,895.

Lastly, U.S. Pat. No. 4,167,432 entitled "Process of Making A Water Bed Mattress" describes a technique for forming a bag-like structure that can accept water and act as a suitable bed mattress.

FIG. 1D illustrates a sheet of commercially available dual melt film including a top surface S1 having a melt temperature T1 and a bottom surface S2 having a melt temperature T2 which is lower than the melt temperature T1 on the top surface S1. Acceptable films are formed from polyether polyurethane. Such films are generally used for purposes other than making self-inflating air mattresses or cushions.

While the prior art does describe a number of efforts to make self-inflating structures, such as mattresses and cushions, nevertheless, when the structures are inflated they tend to have a generally convex shape because the exterior fabric layer does not satisfactorily adhere to the entire foam core. In contrast, Applicant's invention completely adheres to the surface of the foam core thereby permitting larger structures, having a defined shape, and which includes concave and compound portions, flat sides and right angle edges.

SUMMARY OF THE INVENTION

Briefly described, the invention comprises a method and apparatus for making self-inflatable mattresses and cushions having an open pore core and an exterior surface formed from dual melt films. Initially, a core block of open foam material is placed on a flat surface or conveyer belt and a top sheet comprising a layer of dual melt film is placed on top thereof so that the edges of the film drape over the sides of the core. A non-stick, heat transfer, buffer layer is then placed on top of the film so that the top layer of the film does not adhere to the heating agent which could comprise a conventional heating iron or a heat and pressure roller. The film has a top surface S1 having a first melt temperature T1 and a bottom surface S2 having a melt temperature T2 which is lower than the melt temperature T1 of the top surface S1. Heat TR and pressure, preferably from a roller, are then applied to the top sheet. The heat of TR is such that the bottom layer S2 of the dual melt film melts and adheres to the foam core but the top layer S1 does not melt. A pair of heat pressure rollers apply heat, through another buffer layer, to the side portions of the top layer that overlap the edge of the foam core so that the entire top sheet adheres to the foam core leaving only small corner tails to be folded in later and sealed. The foam core is then turned over and a bottom layer of dual melt film is placed on top of it so that its sides drape over the edges of the block and heat and pressure are again applied, through a buffer layer, preferably with a roller, to cause the bottom layer to adhere to the bottom of the foam core. The same pair of side pressure rollers causes the edges that drape over the foam core to adhere to the sides of the core and to the top layer. The tails, or ears, of both sheets are folded in so that they melt and attached to the block. A valve, which can be either an oral inflation valve or one way valve, is then attached to the side of the mattress. The dual melt film completely encases and contacts the outer surface of the foam core. The mattress can then be squeezed and deflated and kept in that position for easy storage. Subsequently, when it is desired to inflate the mattress the valve is opened and the mattress naturally assumes its original shape. Because the dual melt film completely encases the entire core, it is possible to form very rigid structures which may include concave indentations or compound three-dimensional forms. Such structures could include, for example, mattresses for beds, seat cushions, back cushions and special purpose cushions, such as pilot ejection seat cushions.

The invention has several other advantages over the prior art. First, because fabrics are not used, the outer cover does not wrinkle and leak. The dual melt film is relatively soft when applied to the open foam core and conforms to the entire surface thereof. Even through the bottom surface S2 melts, the top surface is relatively soft so that is stretches and conforms to the foam shape whereas cloth is stiff and does not. When the final product is formed, the dual melt film, after it cools, also stretches and moves with the foam core so that it does not wrinkle or pucker and thereby adheres to the basic shape of the foam core when inflated to ambient air temperature or when pressurized. Second, the overlapping end seams are bonded by a weld between the bottom surface S2 of one sheet of film and the top surface S1 of the abutting sheet of film. The result is a seal that not only adheres entirely to the edge of the foam core but also adheres to itself in an absolutely airtight fashion. Third and very importantly, because only heat and pressure is used to laminate the dual melt films together and to the core, the use of adhesives, solvents and hazardous chemicals is avoided.

These and other features of the invention will be more fully understood by reference to the following drawings.

DETAILED DESCRIPTION OF THE INVENTION

During the course of this description, like numbers will be used to identify like elements according to the different figures that illustrate the invention.

Figure 2A:
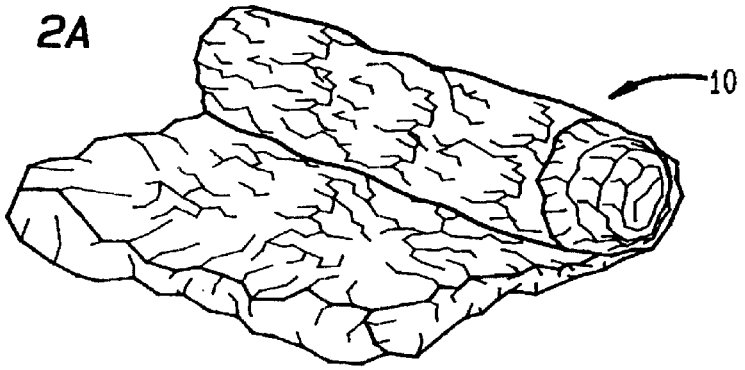
FIG. 2A illustrates the preferred embodiment of the mattress invention in its compressed and rolled up state.
Figure 2B:
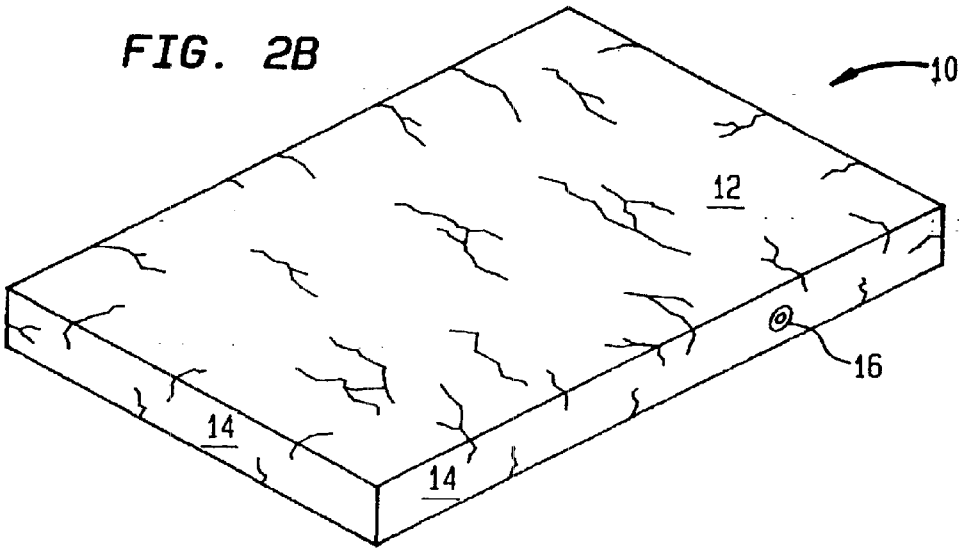
FIG. 2B illustrates the invention as it self-inflates and the air valve is open.
Figure 2C:
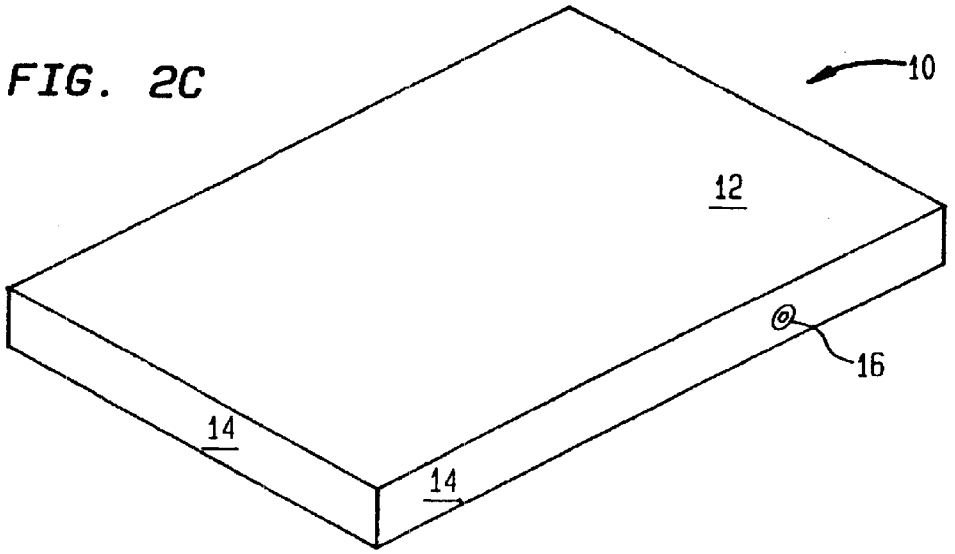
FIG. 2C illustrates the invention in its fully self-inflated state with the air valve closed.

The preferred embodiment 10 of the invention is illustrated in progressive FIGS. 2A–2C.

In FIG. 2A the self-inflatable mattress 10, according to the preferred embodiment thereof, is shown in the collapsed state prior to self-inflation and expansion. In the collapsed state, all of the air has been squeezed out of the mattress and the valve 16 is closed in the evacuated state so that the mattress volume is substantially reduced by at least 50–80%.

If the valve 16 is opened as shown in FIG. 2B, air is drawn in and the top surface 12 and the sides 14 begin to assume a relatively flat shape.

The mattress 10 is illustrated in its fully inflated state in FIG. 2C. Valve 16 is preferably a one-way valve but could be a valve that permits oral inflation. By adjusting the amount of air that enters the mattress 10 through valve 16, it is possible to control the firmness of the mattress 10.

The mattress 10 is preferably formed according to the basic steps illustrated in FIGS. 3A–3L. A block of open pore polyether foam 2 comprises the middle of the mattress. Foam core 20 can be substantially thicker than prior art self-inflating mattresses. There are several commercially available polyether foams that could be used for the core 20. In particular, grades 3100HXXX and 32850XXX work well and have the following specifications:

| | TEST VALUES TYPICAL |
|---|---|
| POLYETHER FOAM GRADE: 3100HXXX | |
| Density, lbs./cubic feet | 1.0 |
| Indentation Force Deflection 25% Defl., 4" | 10 |
| Tensile Strength, psi | 12 |
| Ultimate Elongation, % | 200 |
| Tear Resistance, ppi | 2.0 |
| Combustibility PASSES | CALIFORNIA TECHNICAL BULLETIN #117 |
| Sample Size: 15' × 15' × 4' | |
| POLYETHER FOAM GRADE: 32850XXX | |
| Density, lbs./cubic feet | 1.0 |
| Indentation Force Deflection 25% Defl., 4" | 18 |
| Tensile Strength, psi | 15 |
| Ultimate Elongation, % | 200 |
| Tear Resistance, ppi | 2.0 |
| Comppression Set 50%, 22 hrs 158° F. | 10 Max. |
| Sample Size: 15" × 15" × 4" | |

Reported values are taken from the middle of the middle of a test block

The test method is in accordance with ANSI/ASTM-D-3574-91.

Figure 1A:
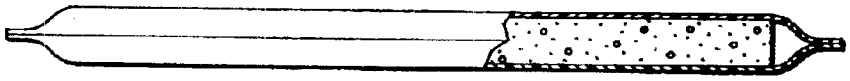
FIG. 1A (PRIOR ART)
FIG. 1A is a partial, cross-sectional view of a prior art self-inflating mattress showing the air gap at the end thereof.
Figure 1B:
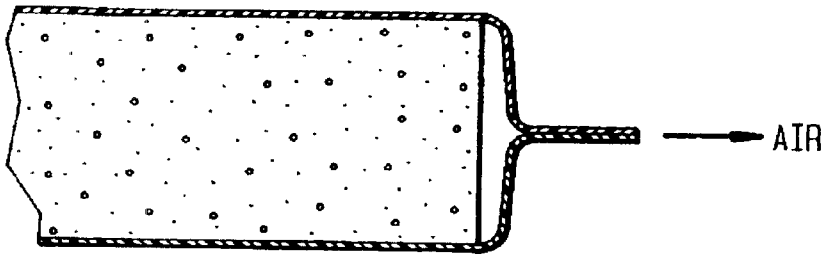
FIG. 1B illustrates the problem of trying to laminate two fabric materials together in a fin seal without losing air at the point of lamination.
Figure 1C:
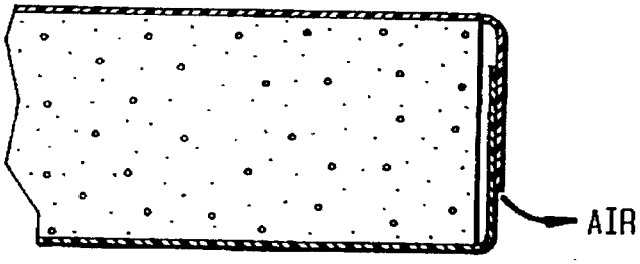
FIG. 1C illustrates the same dilemma when an overlap seam is made, namely that air tends to escape through the laminated portion.
Figure 1D:
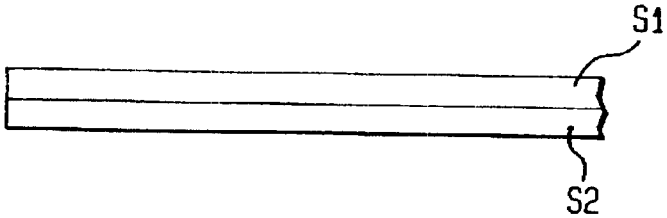
FIG. 1D illustrates a small section of commercial dual melt film having a top surface S1 with a melt temperature T1 and a lower surface S2 with a melt temperature T2 lower than temperature T1.
Figure 3A:
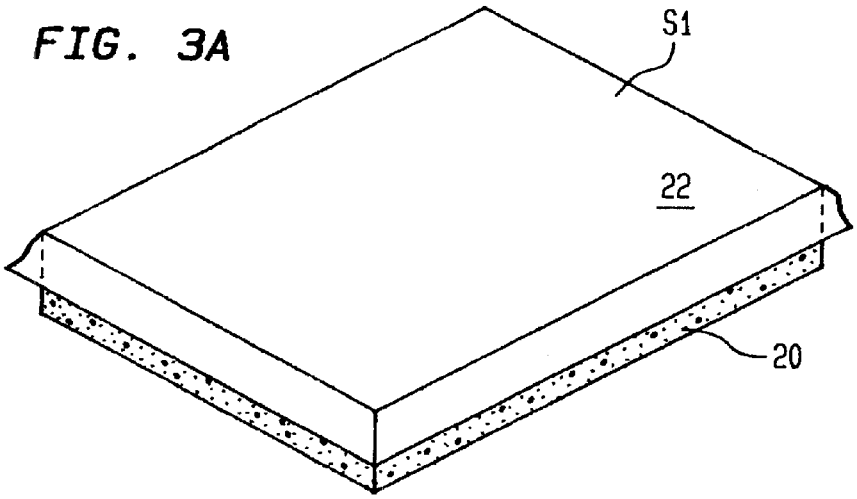
FIG. 3A illustrates the first step of the preferred method of forming the self-inflatable mattress comprising placing a top sheet of dual melt film on top of a block of open pore core material.

According to the first step illustrated in FIG. 3A, a sheet of dual melt film 22 is placed on the top of the foam core 20. The most important characteristic of dual melt film 22 is that it has a top surface S1 with a melt temperature T1 and a bottom surface S2 with a melt temperature T2 which is lower than T1. See FIG. 1D. There are several dual melt films that are acceptable. In particular, Yellow 3012 or Clear 3009 film available from Highland Industries, Inc., 225 Arlington Street, Framingham, Mass. 01702 produce acceptable results. The characteristics of those two dual melt films are as follows:

PRODUCT: Yellow 3012 film on Clear 3009 film

KEY PROPERTIES: A two layer, airholding, heatsealable, low melt/high melt film combination

| | 3012 Film | 3009 Film |
|---|---|---|
| Type: | Polyether Polyurethane | Polyether Polyurethane |
| Color: | Yellow | Clear |
| Thickness: | 2.0 mils | 1.8 mils |
| Vicat Softening Point: | 72 degrees Celsius | 120 degrees Celsius |
| Melt Index: | 50* | 5** |

* g/10 minutes @190 degrees Celsius, 8.7 kg
** g/10 minutes @210 degrees Celsius, 3.8 kg

| PUT UP: | |
|---|---|
| Core Size: | 1.5" or 3" |
| Width Tolerance: | +/−.25" |
| Slit Width: | As specified per factory order |
| Roll Length: | 100 yds |

PHYSICAL PROPERTIES:

| TEST | TYPICAL RESULTS | TEST PROCEDURE |
|---|---|---|
| Weight: | 3.2 oz/sq. yd. | FED STD 191a Method 5041 |
| Thickness: | 3.8 mils | ASTM D 3767 |

In FIG. 1, the bottom surface S2 with the lower melting temperature T2 contacts the upper surface of the open core block 20 so that the top surface S1 having the highest melt temperature T1 faces outward.

Figure 3B:
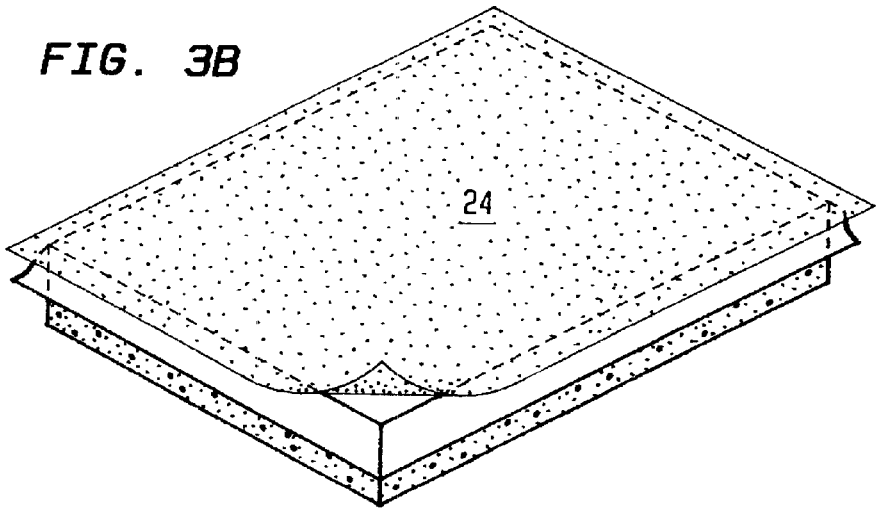
FIG. 3B illustrates the second step of the method in which a non-stick, heat transferable, buffer layer is placed on top of the top layer of dual melt film.

The second step of the method is illustrated in FIG. 3B. A non-stick, heat transfer, buffer sheet or layer 24 is placed on top of the dual melt film 22. There are a variety of buffer materials 24 that are acceptable such as: TFE-GLASS™ (nominal .003"series) fabric such as manufactured by Taconic, P.O. Box 69, Coonbrook Road, Petersburgh, N.Y. 12138. In particular, the TFE-GLASS™ Product No. 7038 was found to be quite satisfactory. It has the following characteristics:

| Product | TFE-GLASS ™ 7038 |
|---|---|
| Catalog Number | F803 |
| Thickness (inches) | .0026 |
| Coated Weight (#/sq. yd.) | .25 |
| Operating Temperature | −100 to +500 F |
| Breaking Strength (PIW) | 70 lbs. |
| Dielectric Strength (volts per mil.) | 600 |
| Standard Full Width (inches) | 37-½ |
| Standard Roll Length | 18 or 36 yards |

Figure 3C:
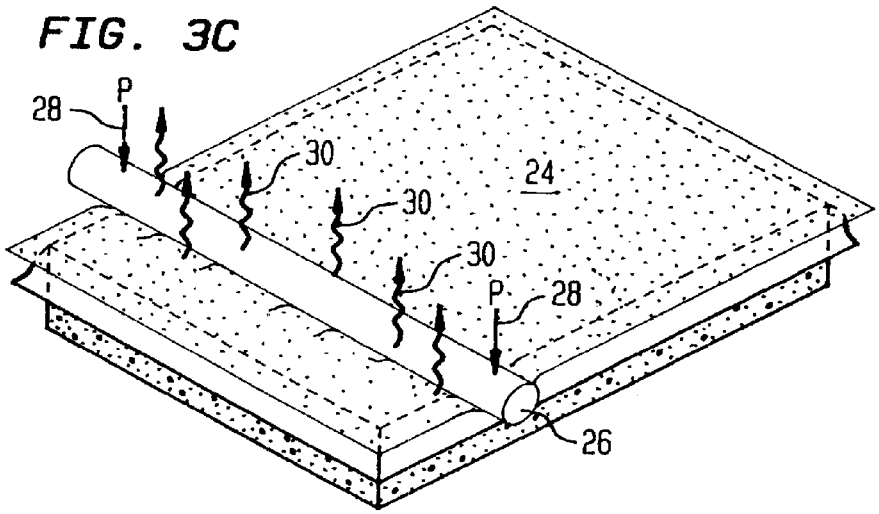
FIG. 3C illustrates the third step of the method where a roller applies heat and pressure to the buffer layer causing the heat to melt the bottom layer S2 of the dual melt film which, in turn, adheres to the top surface of the foam core.

The third step of the method is illustrated in FIG. 3C. A heated roller 26 is brought down with a force P illustrated by arrow 28. Roller 28 is heated to a temperature TR as illustrated by arrows 30. The combination of the heat 30 and the pressure 28 causes the heat 30 to be forced through the buffer layer 24 and the upper layer S1 of the dual melt sheet 22 and to the bottom layer S2 which melts and attaches itself to the top surface of the foam core 20. The temperature TR of the heat 30 from the roller 26 is lower than the melt temperature T1 on the top surface S1 of the dual melt film 22 but higher than the melt temperature T2 of the bottom layer S2 so that the bottom layer becomes sticky and adheres to the top layer of the foam core block 20 yet the top layer S1 remains relatively solid and air impervious.

Figure 3D:
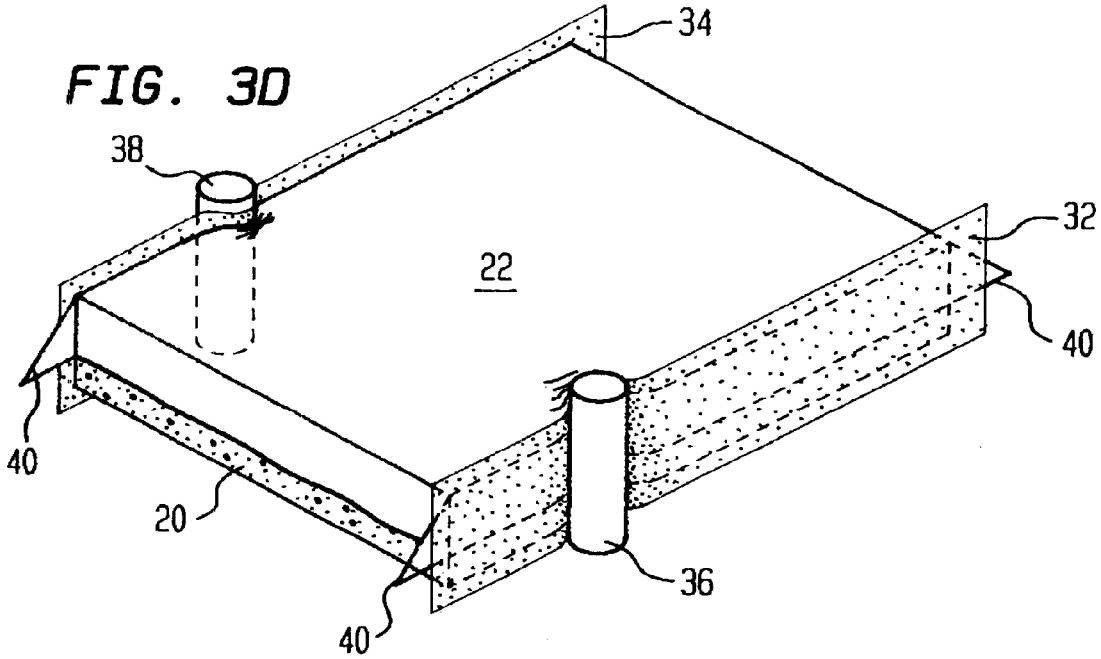
FIG. 3D illustrates the fourth step in which a pair of heated pressure rolls causes two sides of the top sheet to adhere to the foam core.

The fourth step of the method is illustrated in FIG. 3D. A pair of side buffer layers 32 and 34, having non-stick, heat transfer characteristics substantially identical to those of buffer layers 24 is interposed between rollers 36 and 38 and foam core 20. Right side heat and pressure roller 36 applies heat and pressure to the buffer layer 32 which, in turn, heats the overlapping portion of the dual melt sheet 22 causing it to adhere to the foam core 20. Similarly, a left side heat and pressure roller 38 contacts the buffer sheet 34 and causes the overlapping dual melt film 22 to adhere to the other side of the foam core block 20. Tails, or dog-ears, 40 are formed from the excess material 22 that does not get attached to the sides of the block 20 during the first pass.

Figure 3E:
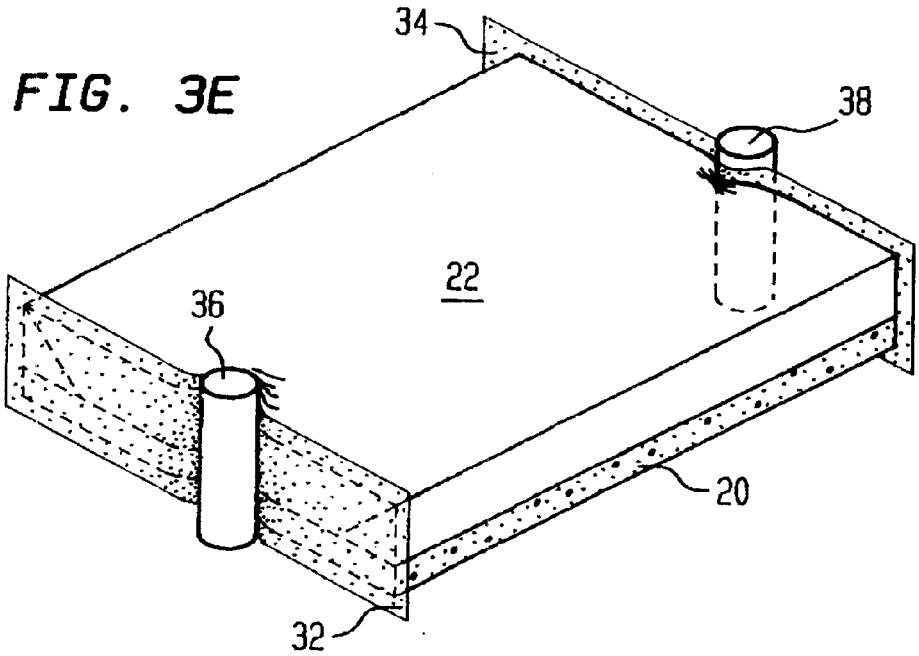
FIG. 3E illustrates the fifth step of the invention in which the remaining two sides of the top sheet are caused to adhere to the foam core by a pair of heated pressure rollers.

The next, of fifth, step in the process is illustrated in FIG. 3E. The block 20 is rotated 90° and the tails 40 are tucked inward. Pressure and heat from rollers 36 and 38 are transferred through buffer layers 32 and 34 to the remaining overlapping portions of the upper dual melt sheet 22 and the folded in tails 40 are sealed in that position in a manner similar to that described with respect to FIG. 3D.

The sixth thorough tenth steps illustrated in FIGS. 3F–3J are essentially identical to the first through fifth steps illustrated in FIGS. 3A–3E except that they are repeated with the foam core 20 turned upside down.

Figure 3F:
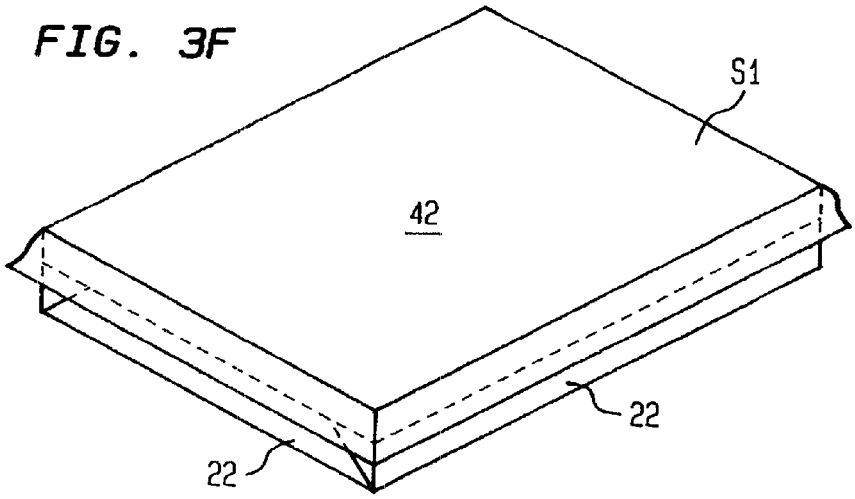
FIG. 3F illustrates the sixth step of the method in which the foam core is inverted and a bottom sheet of dual melt film is placed on top thereof.

According to the sixth step illustrated in FIG. 3F, the core 20 and top sheet 22 are turned upside down and a second, or bottom, sheet of dual melt film 42 is placed on top thereof. The bottom surface S2 having the lower melt temperature T2 contacts the bottom, or exposed portion of the foam core 20 so that the upper surface S1 having the higher melt temperature T1 faces outward.

Figure 3G:
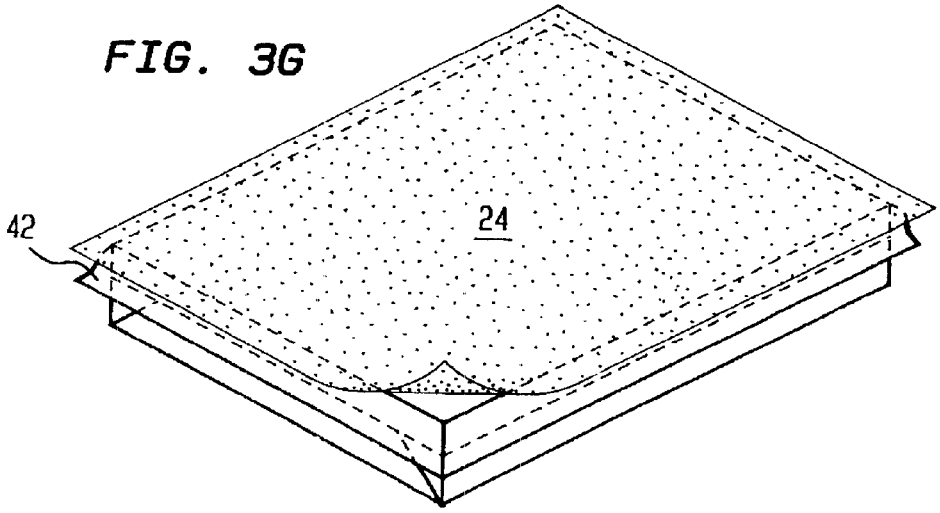
FIG. 3G illustrates the seventh step of the method in which a non-stick, heat transferable, buffer layer is placed on top of the bottom sheet of dual melt film.

The seventh step of the method is illustrated in FIG. 3G. A buffer sheet 24, identical to the one illustrated in FIG. 3B, is placed on top of the bottomdual melt film 42.

Figure 3H:
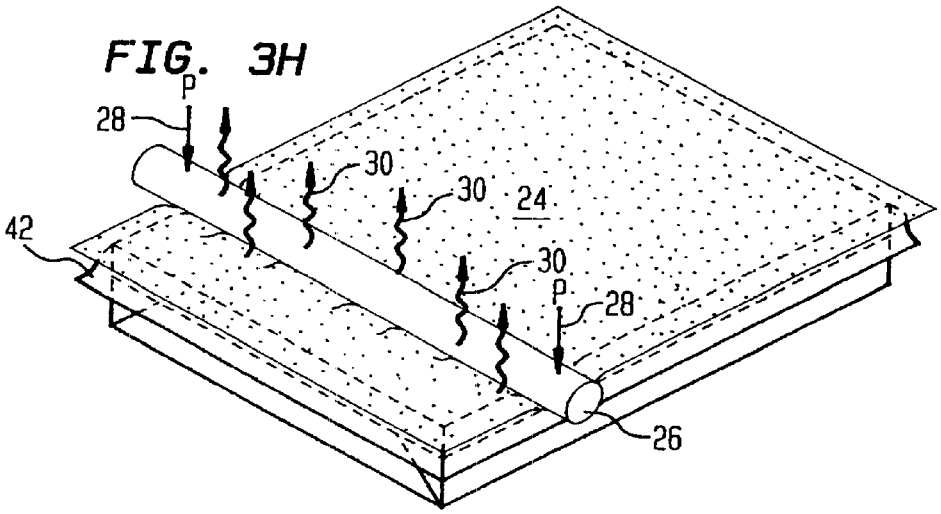
FIG. 3H illustrates the eight step of the method in which a roller applies heat and pressure to the buffer layer causing the heat to transfer to the dual melt film which, in turn, melts and adheres to the bottom of the foam core.

The eighth step of the method is illustrated in FIG. 3H. Heated pressure roller 26 applies pressure 28 and heat 30 to the buffer layer 24. The temperature TR of the heat 30 of the roller 26 is transferred though the buffer layer 24, and the top layer S1 of the dual melt film 42, to the bottom layer S2. Since the heat TR is greater than T2 but less than T1, the bottom layer S2 of the dual melt film 42 melts and adheres to the bottom of the foam core 20.

Figure 3I:
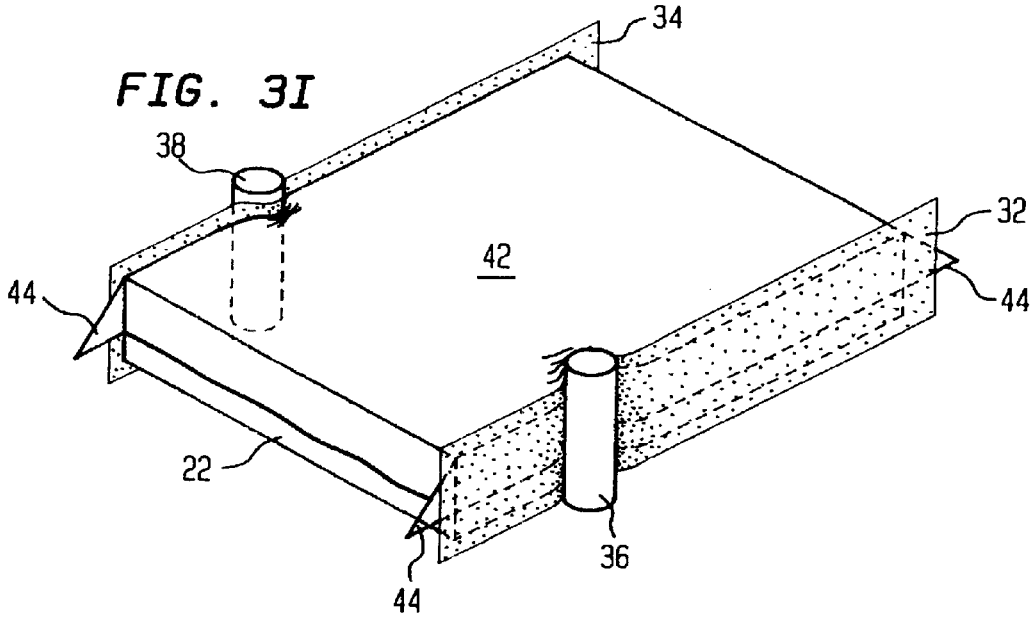
FIG. 3I illustrates the ninth step of the method in which a pair of side rollers causes the overlapping edges of the bottom sheet to adhere to the bottom surface of the foam core and to the overlapping edges of the top sheet.

The ninth step of the method, illustrated in FIG. 3I, comprises sealing two of the four sides of the sheet 42 to the block 20. A pair of non-stick, heat transfer buffer layers 32 and 34 are placed adjacent the overlapping material of the dual melt film 42. A left side heat and pressure roller 36 contacts the buffer 32 and causes the overlapping portion of the dual melt film 42 to adhere to the side of the core 20. Similarly, the left side heat and pressure roller 38 heats the overlapping portion of the film 42 causing that portion to adhere to the side of the foam block 20 and leaving a set of tails, or dog-ears, 44.

Figure 3J:
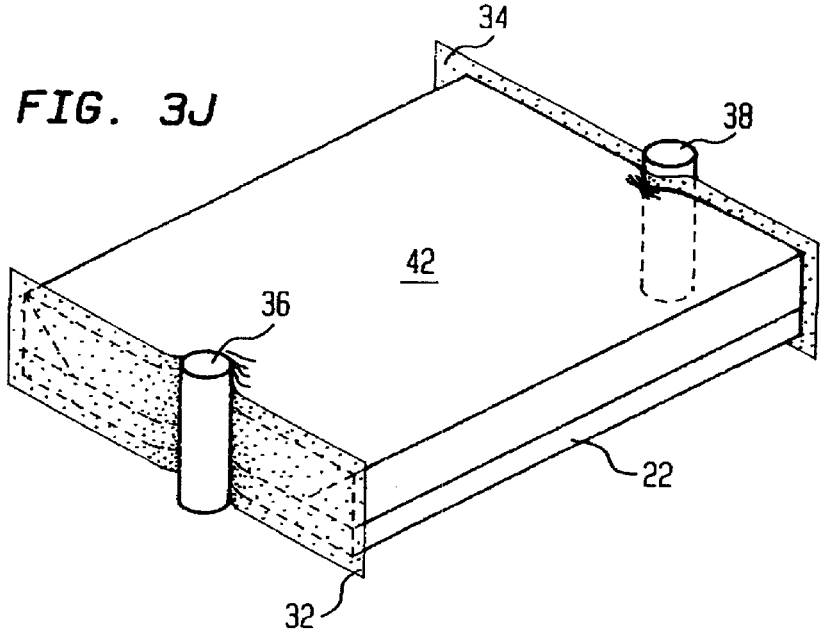
FIG. 3J illustrates the tenth step of the method in which the remaining two sides of the bottom sheet are caused to attach to the foam core and the side portions of the top layer by a pair of heated pressure rollers.

The tenth step of the method is illustrated in FIG. 3J. The core 20 is rotated 90° and the remaining two overlapping portions are sealed to the remaining edges of the core 20. It is also important to note that the bottom portion 42 illustrated in FIGS. 3I and 3J, adhere not only to the foam block 20 itself but also to the tails 44 and to the overlapping portion of the top dual melt film 22 so that the mattress illustrated in FIG. 3J is entirely hermetically sealed with all sides, convex, concave or compound, contacting the dual melt film 22 or 42.

Figure 3K:
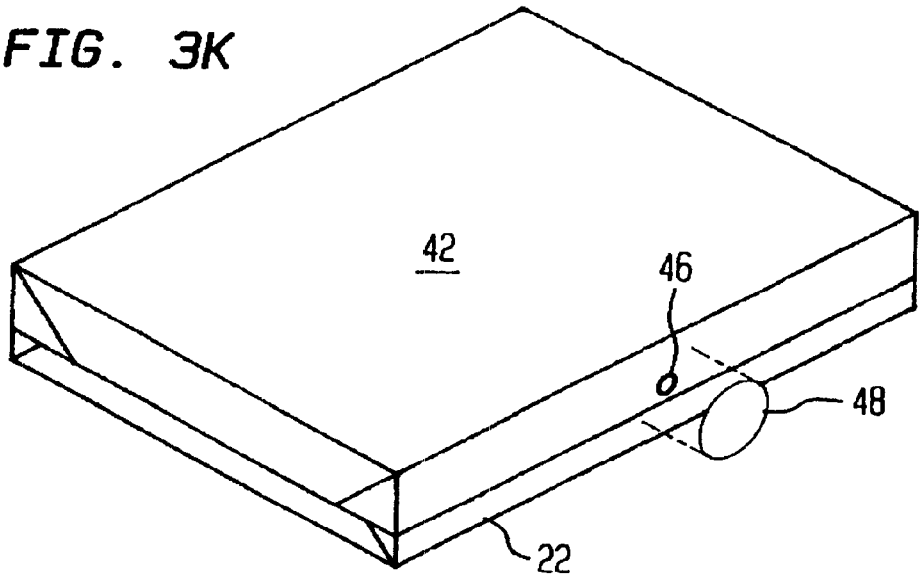
FIG. 3K illustrates the eleventh step of the method in which an air inflation hole is created in the side of the mattress and a base patch is attached thereto.
Figure 3L:
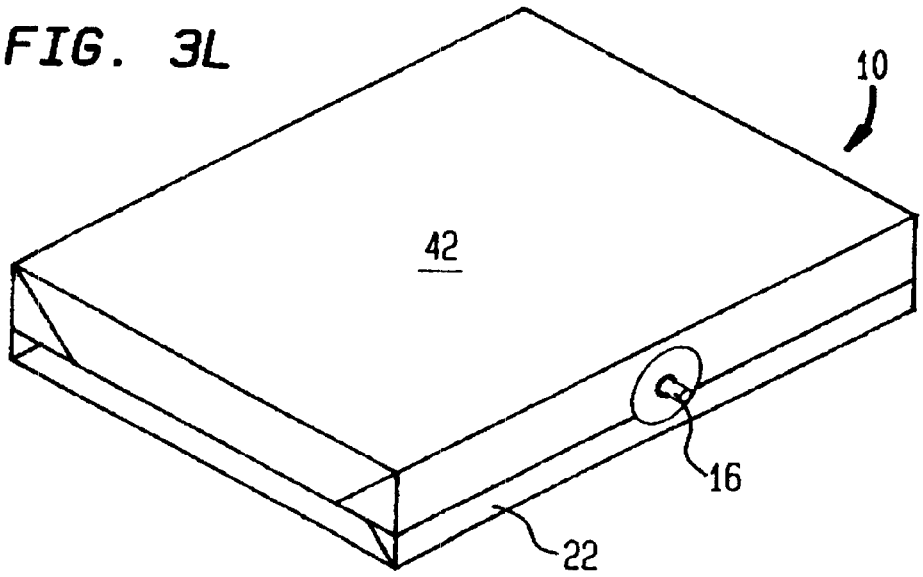
FIG. 3L illustrates the twelfth step of the method comprising attaching a valve to the air inflation hole.

The eleventh and twelfth steps of the method of fabricating the mattress 10, as illustrated in FIGS. 3K and 3L, comprise placing a valve 16 on the mattress 10 and in communication with the interior open pore, foam core 20. As previously discussed, valve 16 can be a one-way valve with or without a cap or a valve suitable for oral inflation. Valves 16 such as described here are available commercially.

The eleventh step of the method illustrated in FIG. 3K comprises punching a hold 46 through one side of the mattress 10. Next, a round patch 48 is preferably placed over the hole 46 to provide a base for valve 16. Patch 48 can be attached adhesively or by means of heat, depending upon the materials used.

The twelfth, and final, step of assembly is illustrated in FIG. 3L. The valve 16 is placed over patch 48, which also has a hole punched through it, and attached in that position with heat or adhesive. It may also be desirable to place another patch 48 with a hole therein over the valve stem 16 for additional strength and support.

Figure 4A:
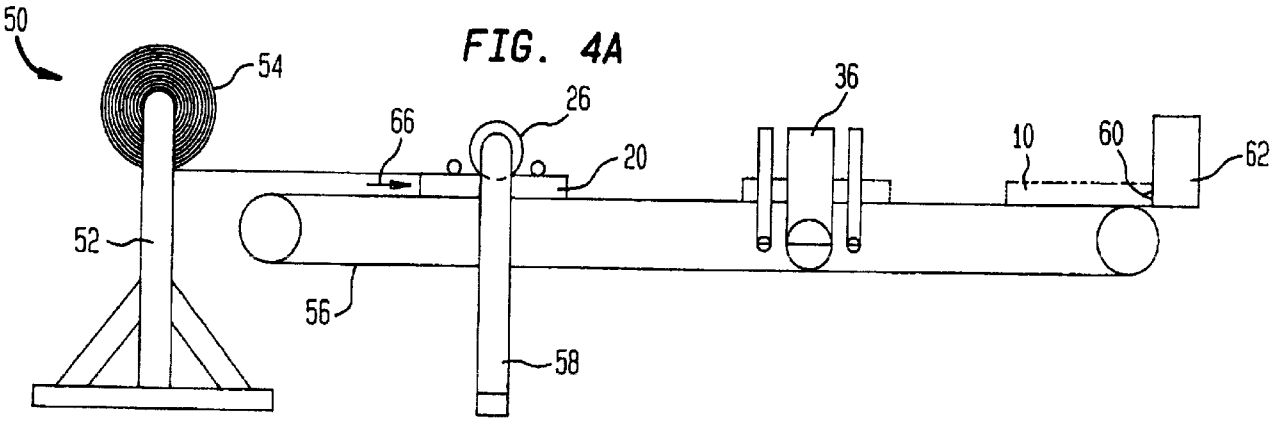
FIG. 4A is a side elevational view of a machine that can accomplish the steps of the preferred embodied of the method as illustrated in FIGS. 3A–3L.
Figure 4B:
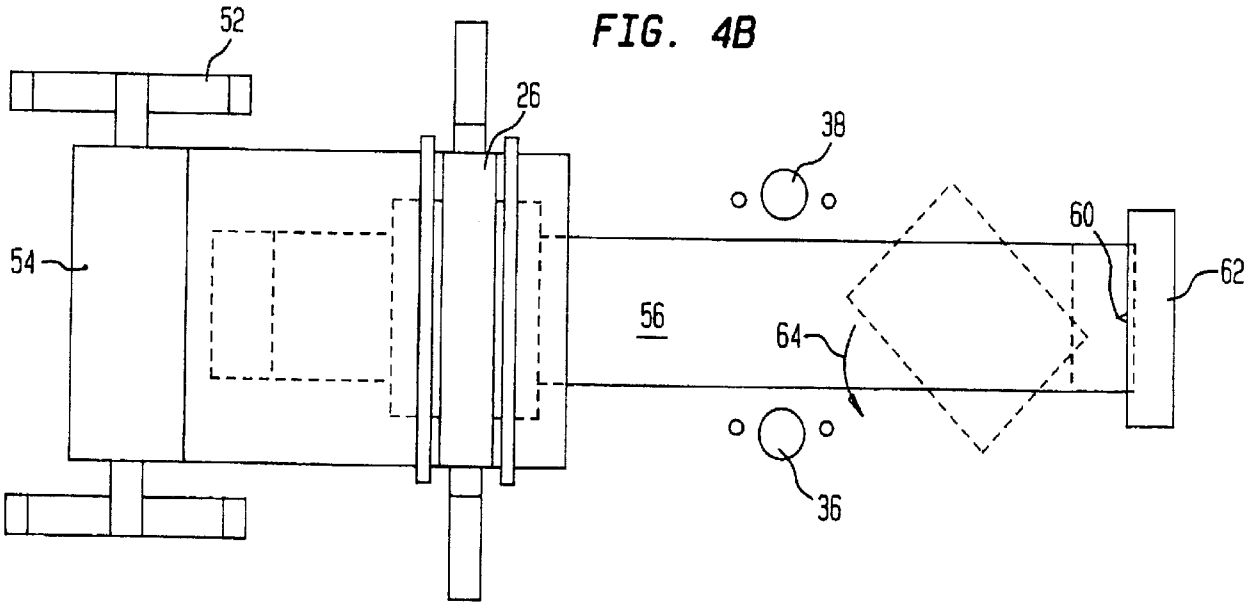
FIG. 4B is a top plan view of the machine illustrated in FIG. 4A.

A machine 50 that can be used to accomplish the twelve steps illustrated in FIGS. 3A–3L, is illustrated in FIGS. 4A and 4B. A film roll support stand 50 holds a roll of dual melt film 54 which can be dispensed over the foam core 20. Foam core 20 is supported by a conveyer belt 56 traveling in the direction of arrow 66 which, in turn, is supported by a conveyer belt support stand 58. The block 20 with the dual melt film 54 placed on top thereof passes under the top heat and pressure roller 26 as originally described with respect to FIGS. 3A–3C and 3F–3H. After the top sheet 22 or bottom sheet 42 has been attached to the block 20, the combination passes through heated side pressure rollers 36 and 38 which cause the sides of the dual melt film to adhesively attach to the core 20 as illustrated in FIGS. 3D, 3E, 3I and 3J. A first pair of sides is usually heated first as illustrated in FIGS. 3D and 3I, then the block is rotated 90° , as indicated by arrow 64, and the remaining two sides are heated under pressure as illustrated in FIGS. 3E and 3J. After the core 20 has been completely encased in dual melt film 22 and 42, as illustrated in 3J, a hole 46 is punched in the side by pin 60 located in the center of conveyer stop 62.

While the preferred embodiment of the invention is directed primarily towards a mattress 10, it can be used to produce a variety of other mattress or cushion devices having concave, convex or compound shapes.

Figure 5A:
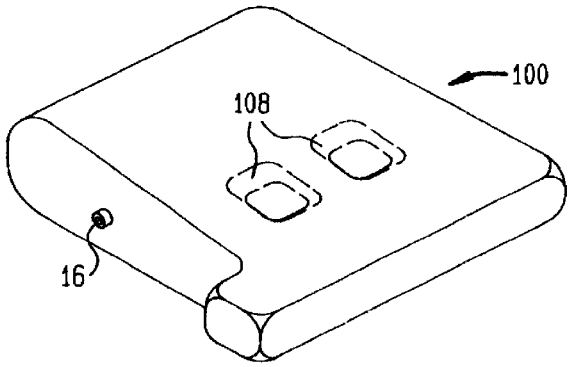
FIG. 5A illustrates a seat cushion embodiment having a pair of concave indents therein.

For example, FIG. 5A illustrates a possible cushion 100 having a pair of indented or concave portions 108 and an inflation valve 16.

Figure 5B:
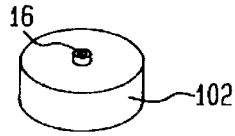
FIG. 5B illustrates a plug embodiment.
Figure 5C:
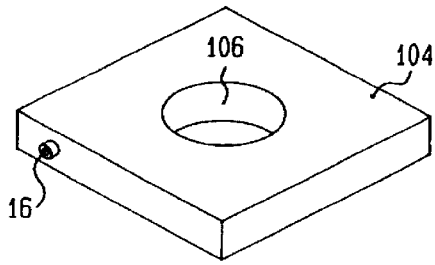
FIG. 5C illustrates a cushion having an aperture therein for receiving the plug illustrated in FIG. 5B.

FIG. 5B illustrates a cylindrical plug 102 having a relatively rigid shape in its expanded form. Cylindrical plug 102 is easily received in aperture 106 in a complimentary cushion 104 illustrated in FIG. 5C.

Figure 5D:
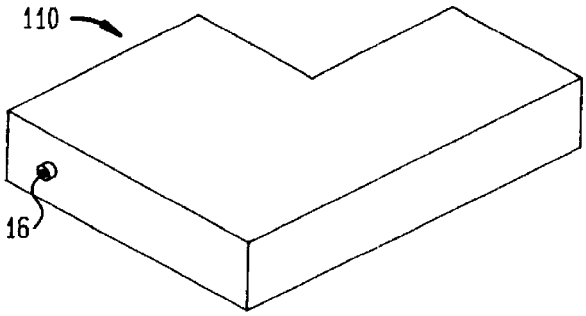
FIG. 5D illustrates an L-shaped cushion embodiment.

An L-shaped foam cushion 110 is illustrated in FIG. 5D and includes a significant side indent therein.

Figure 5E:
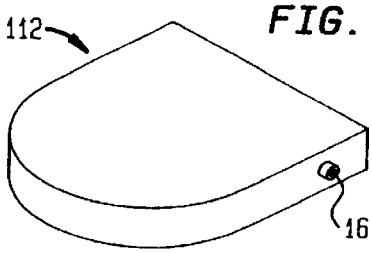
FIG. 5E illustrates a partially semi-circular embodiment of a cushion.
Figure 5G:
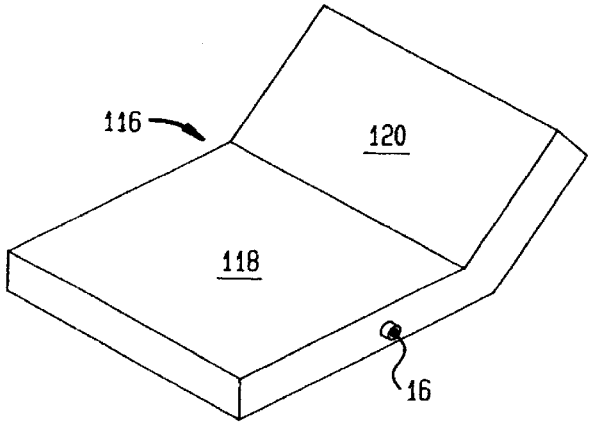
FIG. 5G illustrates a cushion that could, for example, comprise a backrest including a base portion and an oblique back portion attached thereto.

FIG. 5E illustrate a semi-circular or semi-round cushion 112 having one rounded side and one relatively flat side.

Figure 5F:
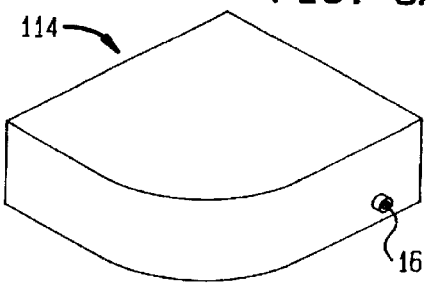
FIG. 5F illustrates a corner, or edge, shaped cushion.

An end, or corner, cushion 114 is illustrated in FIG. 5F and includes one rounded side and two relatively flat sides.

Lastly, a three-dimensional cushion 116, which might comprise, for example, a backrest, includes a base portion 118 and a back portion 120. All of the cushions illustrated in FIGS. 5A–5G can be collapsed and evacuated to size that is, perhaps, 50–80% of their inflated size for ease of storage. The user thereafter merely has to open valve 16 to permit the air to naturally come in and fill the cushion. Alternatively, the user can orally inflate the valve 16 and manually adjust the valve so that the stiffness of the cushion can be selectively modified accordingly to the needs of the user.

Figure 6A:
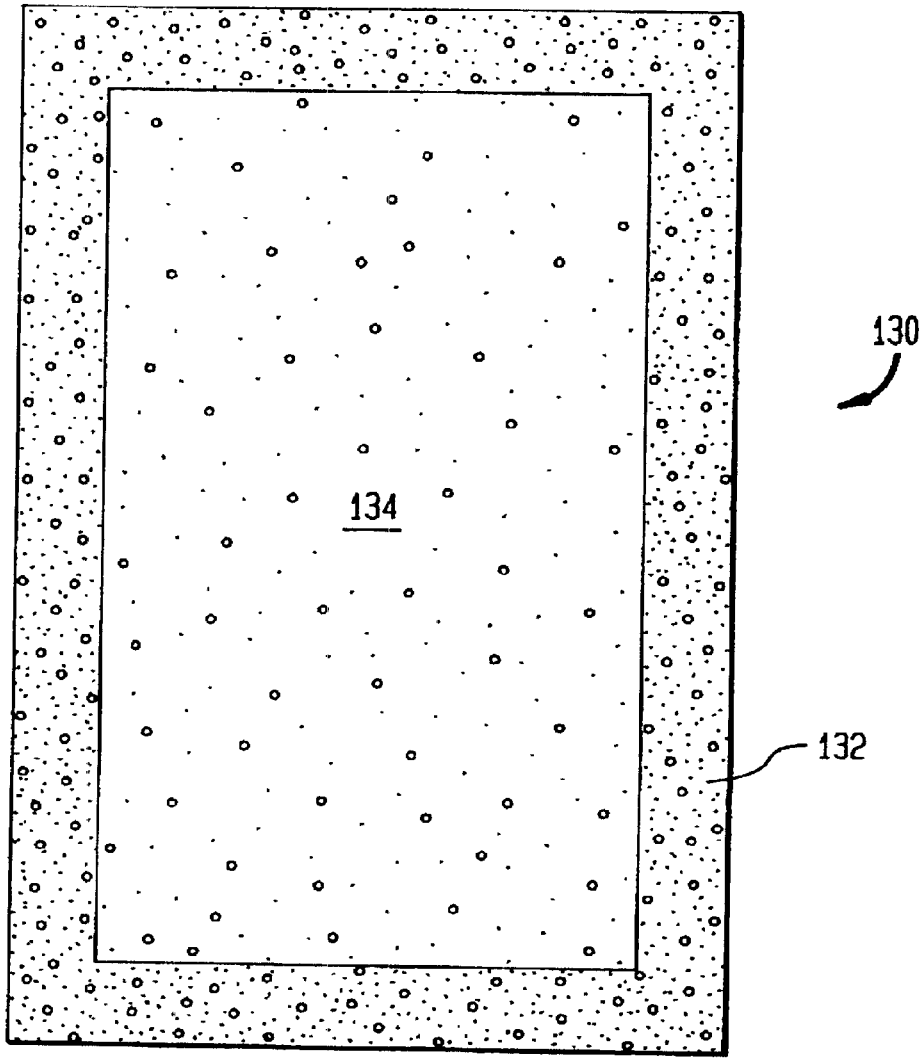
FIG. 6A is a top plan view of an alternative core embodiment in which the outside portion of the core has a higher density than the inside portion thereof.
Figure 6B:
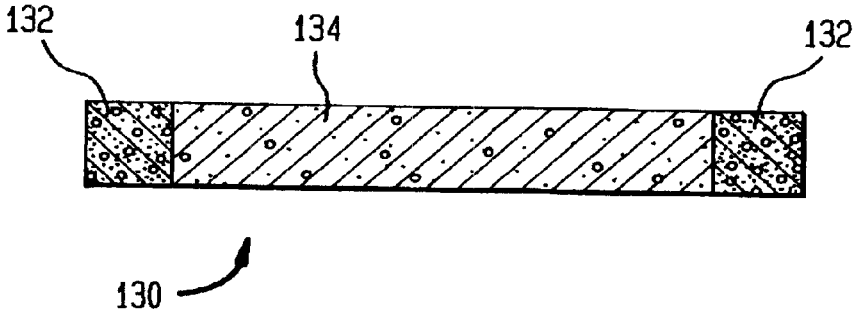
FIG. 6B is a cross-sectional view of the dual density core illustrated in FIG. 6A.

An alternative embodiment of the invention comprises the use of a mattress foam core 130 having dual density as illustrated in FIGS. 6A and 6B. According to alternative embodiment 130, the mattress core includes a denser outer portion 132 and a softer central portion 134. The denser outer portion 132 helps guarantee that the mattress 10 retains a crisp, well defined exterior shape.

Figure 7A:
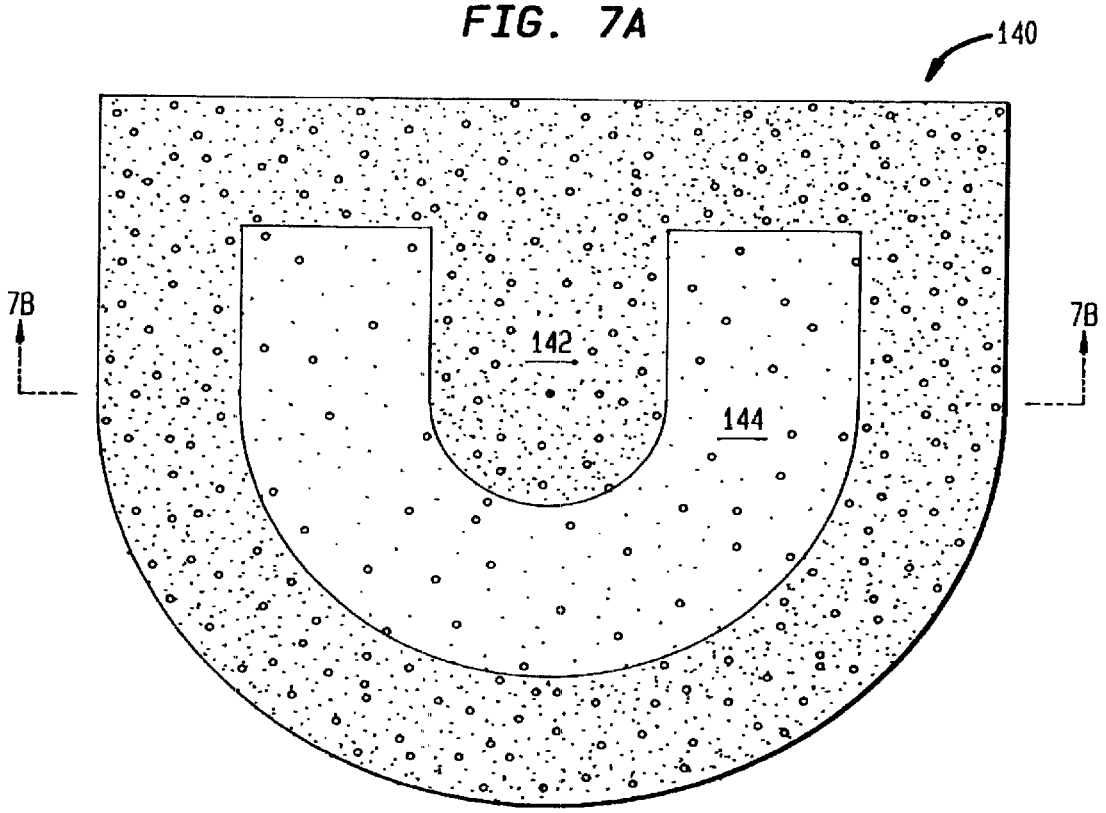
FIG. 7A is a top plan view of another alternative, dual density foam core suitable for use as a seat cushion.
Figure 7B:
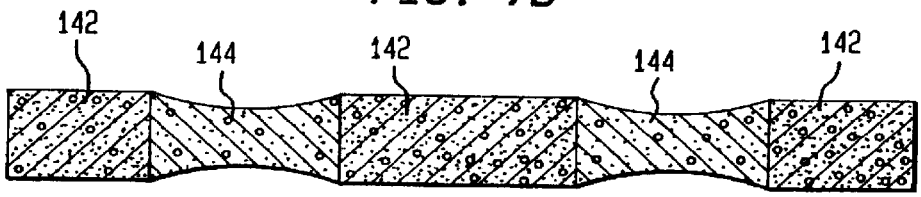
FIG. 7B is a cross-sectional view of the dual density core illustrated in FIG. 7A.

Another alternative embodiment 140 is illustrated in FIGS. 7A and 7B. Alternative embodiment 140 comprises the core of a seat cushion having a dual density in which the outer portion 142 has a higher density than the softer, inner portion 144. Inner portion 144 is not only of a lower density but also is slightly indented to fit the natural contours of the human buttocks. One major advantage of the present invention is that the dual melt film adheres substantially 100% to the exterior surface of the foam core thereby permitting the ultimate mattress 10 or cushion to assume a variety of well defined concave, convex, or compound shapes.

Figure 8A:
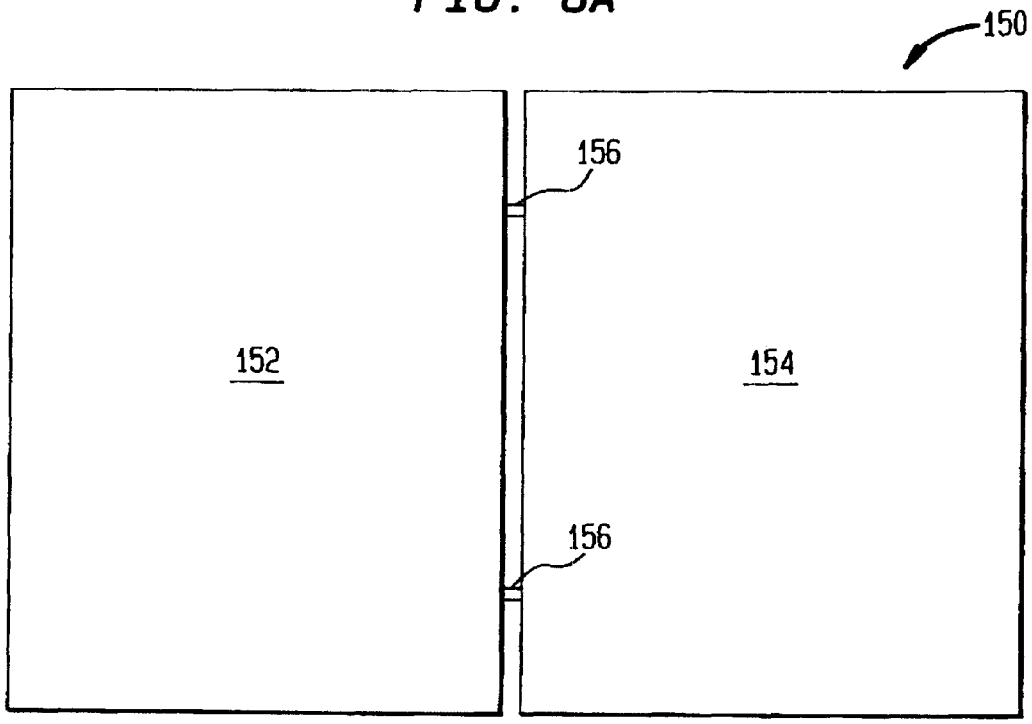
FIG. 8A illustrates a dual mattress embodiment in which two separate self-inflatable mattresses abut each other and are connected together by one or more valves.
Figure 8B:
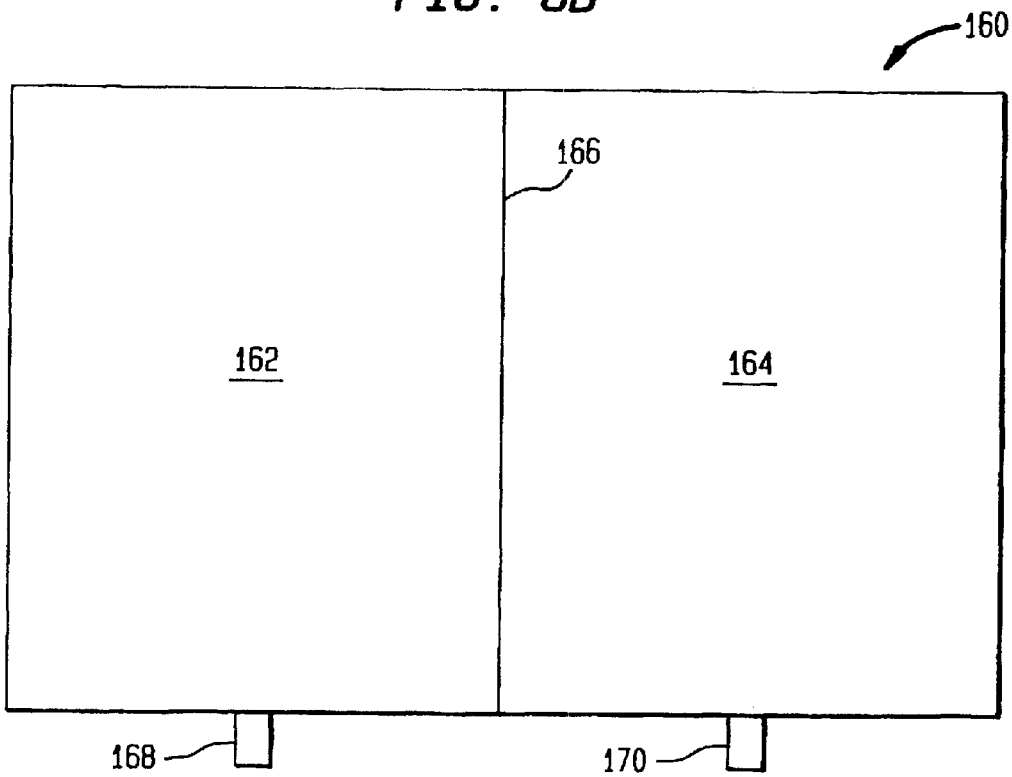
FIG. 8B illustrates an alternative dual mattress embodiment in which two separate self-inflatable mattresses abut each other and are attached directly to each other but in a non-communicating fashion and in which the two separate self-inflatable air mattresses have separate self-inflation valves.

Lastly, FIG. 8B illustrates an alternative embodiment 150 of the invention in which two independently self-inflatable mattresses, sections 152 and 154, are connected together by a pair of valves 156. The firmness of the respective two sides 152 and 154 of the combined king size mattress 150 can be independently adjusted by controlling the flow of air through valves 156. It may also be desirable to cover the exterior of the mattress 150 or any of the other cushions or mattresses described herein with a fabric or cloth material for improved strength and durability.

FIG. 8B illustrates an alternative embodiment 160 of the dual mattress concept. Embodiment 160 comprises a pair of identical self-inflatable portions 162 and 164 connected to, and abutting each other, at seam 166. Unlike embodiment 150 of FIG. 8A, there is no internal communication between mattress compartments 162 and 164. Instead, each individual mattress compartment 162 and 164, respectively, has an individual self-inflation valve 168 and 170. Therefore, either side of the mattress may be independently and selectively controlled for firmness depending upon the setting of vales 168 and 170 or the pressurization thereof.

There are alternative means and methods for applying heat and pressure to the dual melt film and the underlying open pore foam core other than heated, pressurized rollers. For example, a large flat heated iron press could be employed or, alternatively, a hot air blow dryer could achieve some of the same results. While specific heating and pressurizing techniques have been described in this disclosure, it will be appreciated by those of ordinary skill in the art that other heat and pressurizing technique might also be suitable.

While the invention has been described with reference to the preferred embodiment thereof, it will be appreciated by those of ordinary skill in the art that modifications can be made to the method and apparatus for forming the mattress and cushion, or the mattress or cushion itself, without departing from the spirit and scope of the inventing as a whole.

What is claimed is:

1. An apparatus for making a self-inflatable device from a core of open pore foam and a film having a first surface that melts a first temperature T1 and a second surface that melts at a second temperature T2 which is lower than T1 and such that the second surface substantially contacts the entire exterior surface of said core of open pore foam, said apparatus comprising:

heating means for heating said first surface to a temperature TR lower than T1 but higher than T2 so that said second surface melts and adheres to substantially the entire exterior surface of said core of open pore foam; and pressure means for applying pressure to said heating means against said film to ensure that said second surface of said film melts and adheres to said core of open pore form.

2. An apparatus for making a self-inflatable device from a core of open core foam of a predetermined shape comprising:

a means for dispensing a non-fabric containing, dual melting point film having a first surface (S1) that melts at a first temperature T1 and a second surface (S2) substantially adjacent to said first surface that melts at a second temperature T2 which is lower than T1 and such that the second surface (S2) substantially contacts the entire exterior surface of said core of open pore foam;

a first roller means for applying heat to aid dual melt film for heating said first surface to a temperature TR lower than T1 but higher than T2 so that said second surface melts and adheres to substantially the entire exterior surface of said core of open pore foam and for applying pressure to said non-fabric containing dual melting point film to cause said second surface of said film to melt and adhere to said core of open pore foam;

at least a second roller means for applying heat to said dual melt film for heating said first surface to a temperature TR lower than T1 but higher than T2 so that said second surface melts and adheres to substantially the entire exterior surface of said core of open pore foam and for applying pressure to said non-fabric containing dual melting point film to cause said second surface of said film to melt and adhere to a different surface of said core of open pore foam; and conveyor means for conveying said core and said film from said first roller means to second roller means.

3. The apparatus of claim 2 further comprising:

a non-stick, heat transferable, buffer means locatable between said roller means and said core for preventing said roller means from sticking to said film.

4. The apparatus of claim 3 further including:

a puncture means for puncturing said film located downstream of said second roller means.

5. The apparatus of claim 4 wherein said second roller means comprises at least a second and a third roller for applying the heat and pressure to opposite sides of said foam core.

6. An apparatus for making a self-inflatable device from a core of open pore foam having a predetermined shape and at least one edge, said apparatus comprising:

a. substantially surrounding said core with at least two (2) non-fabric dual melting point films each having a surface (S1) that melts at a first temperature T1 and a second surface (S2) substantially adjacent to said first surface S1) that melts at a second temperature T2 which is lower than T1 and such that said second surface (S2) substantially contacts the entire exterior surface of said core of open pore foam and wherein said second film overlap second film overlap each other adjacent to said edge;

b. heating means for heating said first surface (S1) of said first film and said second film to a temperature TR lower than T1 but higher than T2 such that said second surface melts and adheres to substantially the entire exterior surface including said edge of said core of open pore foam and wherein the top surface (S1) softens and conforms to aid predetermined shape of said core including said edge, wherein the overlapping portions of said first film and said second film form airtight thermoplastic end seam seals and further wherein when said self-inflatable device has cooled, the first outer surface (S1) assumes said predetermined shape of said core and stretches and moves with said core of open pore foam.

* * * * *